US012678916B2

(12) United States Patent
Yamada et al.

(10) Patent No.: US 12,678,916 B2
(45) Date of Patent: Jul. 14, 2026

(54) SHOT-BLASTING DEVICE, INSPECTION METHOD, AND COMPUTER-READABLE STORAGE MEDIUM RECORDING INSPECTION PROGRAM

(71) Applicant: SINTOKOGIO, LTD., Nagoya (JP)

(72) Inventors: Yusuke Yamada, Nagoya (JP); Isaku Kenjo, Nagoya (JP); Takehiro Okamoto, Nagoya (JP); Takeyuki Sugiura, Nagoya (JP); Satoshi Kobayashi, Nagoya (JP)

(73) Assignee: SINTOKOGIO, LTD., Aichi (JP)

( * ) Notice: Subject to any disclaimer, the term of this patent is extended or adjusted under 35 U.S.C. 154(b) by 320 days.

(21) Appl. No.: 17/943,393

(22) Filed: Sep. 13, 2022

(65) Prior Publication Data

US 2023/0094998 A1 Mar. 30, 2023

(30) Foreign Application Priority Data

Sep. 30, 2021 (JP) ..... 2021-161865

(51) Int. Cl.
*B24C 7/00* (2006.01)
*B24C 1/10* (2006.01)
*B24C 3/14* (2006.01)

(52) U.S. Cl.
CPC ..... *B24C 7/0092* (2013.01); *B24C 1/10* (2013.01); *B24C 3/14* (2013.01)

(58) Field of Classification Search
CPC ... B24C 7/0092; B24C 7/0015; B24C 7/0053; B24C 5/06; B24C 3/04; B24C 3/14; B24C 3/24; B24C 3/30; B24C 1/10
See application file for complete search history.

(56) References Cited

U.S. PATENT DOCUMENTS 4,734,681 A * 3/1988 Suzuki ..... B05B 12/08 239/71
5,620,362 A * 4/1997 Kuehn ..... B24C 3/14 451/81

(Continued)

FOREIGN PATENT DOCUMENTS

CN 101950940 A 1/2011
CN 102707656 A * 10/2012

(Continued)

OTHER PUBLICATIONS

Translation of KR 100662228 B1 (Year: 2006).*

(Continued)

*Primary Examiner* — Joel D Crandall
*Assistant Examiner* — Steven Huang
(74) *Attorney, Agent, or Firm* — Harness, Dickey & Pierce, P.L.C.

(57) ABSTRACT

A processor (213) carries out, after a device is activated and before a blasting medium projected to a projection target object (500), a first inspection process (T1) for determining, in a state in which no blasting medium (400) is supplied to an impeller (110) while each motor of the impeller is rotating, whether a current value supplied to the each motor of the impeller is not more than a first threshold (θ1), and a second inspection process (T'1) for determining, in a state in which the impeller is projecting the blasting medium, whether the current value supplied to the each motor of the impeller is not less than a second threshold (θ2), and displays, on a display (300), at least one of (1) respective determination results of the first inspection process and the second inspection process and (2) a determination result obtained by generalizing the determination results (1).

9 Claims, 6 Drawing Sheets

(56) References Cited

U.S. PATENT DOCUMENTS

| | | | | | |
|---|---|---|---|---|---|
| 5,975,985 | A * | 11/1999 | Sutherland | B24C 3/067 451/446 |
| 2002/0175219 | A1* | 11/2002 | Rochat | B24C 7/0053 239/69 |
| 2008/0086230 | A1* | 4/2008 | Maeda | G05B 19/40937 700/187 |
| 2009/0128283 | A1 | 5/2009 | Yamamoto et al. | |
| 2013/0115853 | A1 | 5/2013 | Yamamoto et al. | |
| 2015/0290770 | A1 | 10/2015 | Ishikawa et al. | |
| 2019/0062858 | A1* | 2/2019 | Sanders | B24C 5/04 |
| 2021/0354266 | A1 | 11/2021 | Shafferkoetter et al. | |
| 2022/0395960 | A1* | 12/2022 | Reinmann | B24C 7/00 |

FOREIGN PATENT DOCUMENTS

| | | | | | |
|---|---|---|---|---|---|
| CN | 104999376 | A | * | 10/2015 | |
| CN | 110253449 | A | | 9/2019 | |
| CN | 213957894 | U | * | 8/2021 | |
| CN | 114808632 | A | * | 7/2022 | B24C 1/06 |
| GB | 1177927 | A | | 1/1970 | |
| JP | H02311268 | A | | 12/1990 | |
| JP | H05-002869 | U | | 1/1993 | |
| JP | 2868172 | B2 | * | 3/1999 | |
| JP | 2002-011665 | A | | 1/2002 | |
| JP | 2007-268649 | A | | 10/2007 | |
| JP | 2012-030313 | A | | 2/2012 | |
| KR | 20060111914 | A | * | 10/2006 | |
| KR | 100662228 | B1 | * | 12/2006 | |
| WO | 2013/186939 | A1 | | 12/2013 | |
| WO | WO-2019146529 | A1 | * | 8/2019 | B24C 1/10 |

OTHER PUBLICATIONS

Translation of WO 2019146529 A1 (Year: 2019).*
Translation of CN 213957894 U (Year: 2021).*
Translation of CN 102707656 A (Year: 2012).*
Translation of CN 104999376 A (Year: 2015).*
Translation of KR 20060111914 A (Year: 2006).*
Translation of JP 2868172 B2 (Year: 1999).*
Translation of CN 114808632 A (Year: 2022).*

* cited by examiner

FIG. 6

σ23

σ3

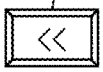

σ31

| | PRE-OPERATION INSPECTION HISTORY | IMPELLER 111 | | IMPELLER 112 | | CONVEYER | | DISTRIBUTOR | | SCREW | | BUCKET ELEVATOR | | DUST COLLECTING DEVICE | |
|---|---|---|---|---|---|---|---|---|---|---|---|---|---|---|---|
| STARTING DATE AND TIME | OVERALL | NON-PROJECTION | PROJECTION | NON-PROJECTION | PROJECTION | NON-PROJECTION | PROJECTION | NON-PROJECTION | PROJECTION | NON-PROJECTION | PROJECTION | NON-PROJECTION | PROJECTION | NON-PROJECTION | PROJECTION |
| 11:24 ON JULY 18 | ○ | ○ | ○ | ○ | ○ | ○ | ○ | ○ | ○ | ○ | ○ | ○ | ○ | ○ | ○ |
| 11:24 ON JULY 19 | ○ | ○ | ○ | ○ | ○ | ○ | ○ | ○ | ○ | ○ | ○ | ○ | ○ | ○ | ○ |
| 11:24 ON JULY 20 | ○ | ○ | ○ | ○ | ○ | ○ | ○ | ○ | ○ | ○ | ○ | ○ | ○ | ○ | ○ |
| 11:24 ON JULY 21 | ○ | ○ | ○ | ○ | ○ | ○ | ○ | ○ | ○ | ○ | ○ | ○ | ○ | ○ | ○ |
| 11:24 ON JULY 22 | ○ | ○ | ○ | ○ | ○ | ○ | ○ | ○ | ○ | ○ | ○ | ○ | ○ | ○ | ○ |
| 11:24 ON JULY 23 | ○ | ○ | ○ | ○ | ○ | ○ | ○ | ○ | ○ | ○ | ○ | ○ | ○ | ○ | ○ |
| 11:24 ON JULY 24 | △ | ○ | △ | ○ | ○ | ○ | ○ | ○ | ○ | ○ | ○ | ○ | ○ | ○ | ○ |

SHOT-BLASTING DEVICE, INSPECTION METHOD, AND COMPUTER-READABLE STORAGE MEDIUM RECORDING INSPECTION PROGRAM

This Nonprovisional application claims priority under 35 U.S.C. § 119 on Patent Application No. 2021-161865 filed in Japan on Sep. 30, 2021, the entire contents of which are hereby incorporated by reference.

TECHNICAL FIELD

The present invention relates to a shot-blasting device, an inspection method, and a computer-readable storage medium recording an inspection program.

BACKGROUND ART

In a shot-blasting device, an overload protective device such as a thermal relay is conventionally known as an anomaly detection system that detects whether an overload has caused a malfunction in a motor or a part involved in driving of the motor. Also known is a system that uses a sensor to remotely monitor operation at regular intervals.

CITATION LIST

Patent Literature

Patent Literature 1

Japanese Patent Application, Tokugan, No. 2002-011665

SUMMARY OF INVENTION

Technical Problem

However, according to such a protective device, monitoring is carried out after a production line has started to operate. Thus, in many cases, a malfunction has already occurred in any of parts of a shot-blasting device before an anomaly is detected. This unfortunately results in stopping of production until completion of a replacement work. Thus, a pre-operation inspection is critical. However, it is sometimes impossible to easily carry out the pre-operation inspection, which requires high cost in terms of time and equipment.

An aspect of the present invention has an object to not only achieve automation of a pre-operation inspection of a device but also automate determination that the device is in normal operation and determination that the device is ready to produce a non-defective product.

Solution to Problem

In order to attain the object, a shot-blasting device in accordance with an aspect of the present invention includes an at least one impeller and at least one processor. Each of the at least one impeller has at least one motor and projects a blasting medium to at least one projection target object. The at least one processor carries out a first inspection process and a second inspection process before the blasting medium is projected to the at least one projection target object. The first inspection process is a process for determining, in a state in which no blasting medium is supplied to the at least one impeller while the at least one motor is rotating, whether a current value supplied to each of the at least one motor of the at least one impeller is not more than a first threshold. The second inspection process is a process for determining, in a state in which the at least one impeller is projecting the blasting medium, whether the current value supplied to each of the at least one motor of the at least one impeller is not less than a second threshold. The at least one processor carries out a display process for displaying, on a display, at least one of the following (1) and (2):

(1) a determination result of the first inspection process and a determination result of the second inspection process; and (2) a determination result obtained by generalizing the determination result of the first inspection process and the determination result of the second inspection process.

A shot-blasting device in accordance with each aspect of the present invention can be realized by a computer. In this case, the scope of the invention also encompasses (i) a shot-blasting device inspection program for causing the computer to realize the shot-blasting device by causing the computer to operate as sections (software elements) of the shot-blasting device and (ii) a computer-readable storage medium recording the shot-blasting device inspection program.

Advantageous Effects of Invention

An aspect of the present invention achieves automation of a pre-operation inspection of a device. Furthermore, an aspect of the present invention also automates determination that the device is in normal operation and determination that the device is ready to produce a non-defective product. This contributes to greater efficiency.

BRIEF DESCRIPTION OF DRAWINGS

FIG. 6 is a view illustrating an example of a screen for displaying an inspection result.

DESCRIPTION OF EMBODIMENTS

Embodiment 1

(Configuration of Shot-Blasting Device)

Figure 1:
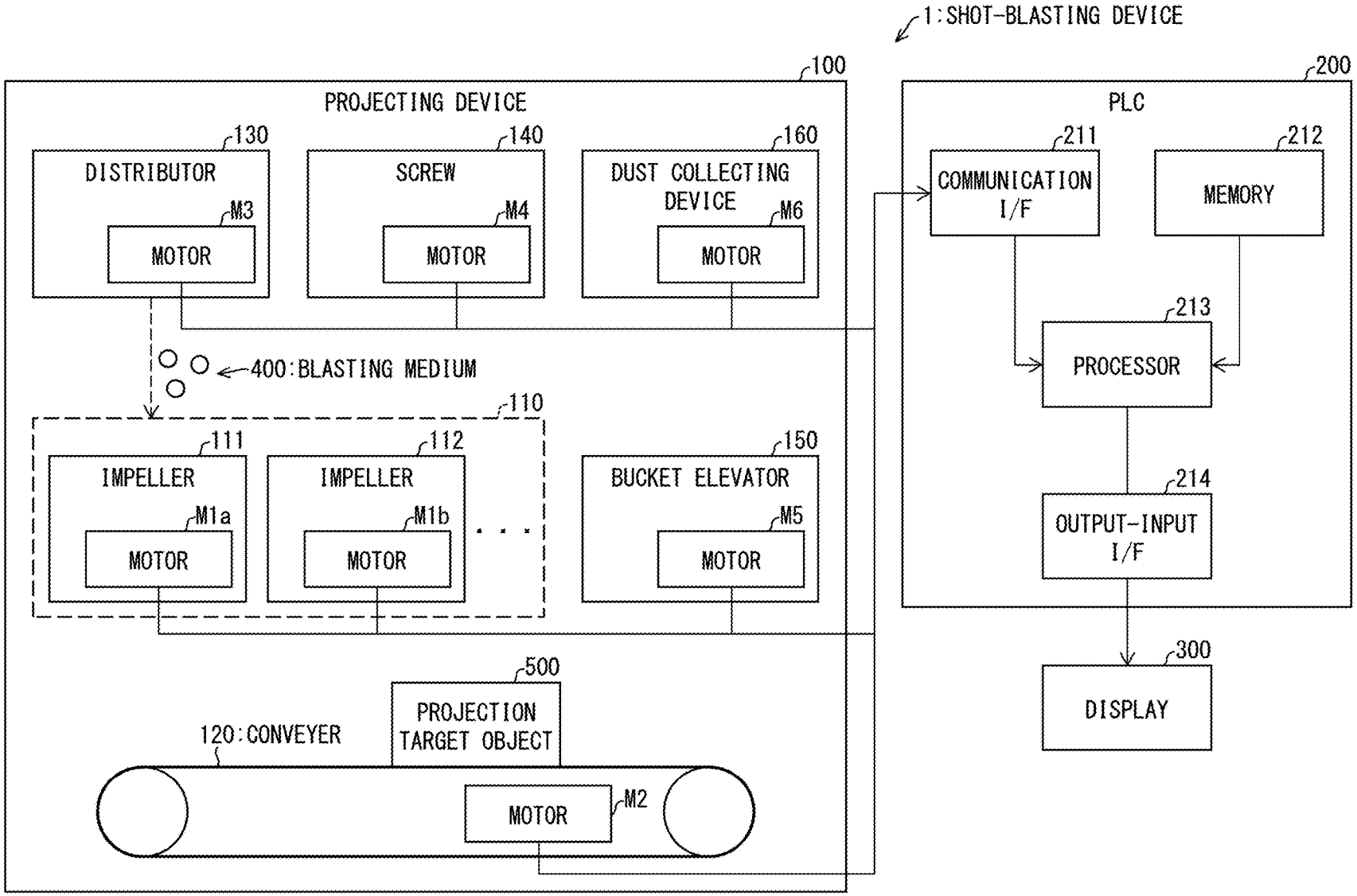
FIG. 1 is a block diagram illustrating a configuration of a shot-blasting device.

The following description will discuss, with reference to FIG. 1, a configuration of a shot-blasting device 1 in accordance with an embodiment of the present invention. FIG. 1 is a block diagram illustrating the configuration of the shot-blasting device 1.

The shot-blasting device 1 includes a projecting device 100, a programmable logic controller (PLC) 200, and a display 300 as illustrated in FIG. 1. The projecting device 100 projects (shots out) a blasting medium 400, which is externally supplied, to a projection target object 500 so as to carry out, for example, a surface fabrication process such as removal of a burr in the projection target object 500 and/or adjustment of surface roughness. Note here that the burr refers to an excess material part protruding on an edge or the like of the projection target object 500 during production of the projection target object 500. The blasting medium 400 is exemplified by spherical metallic particles (so-called shots) and acute-angled metallic particles (so-called grids). Alternatively, the blasting medium 400 may be particles of nonmetals (e.g., glass, ceramics, sand, resins, or plant seeds). The projection target object 500 is, for example, an industrial product such as a casting. An amount of the blasting medium 400 to be projected per unit surface area of the projection target object 500 is referred to as a projection density. The projection density affects projection quality. A constant projection density is necessary for maintenance of constant projection quality.

The PLC 200 controls the projecting device 100. The display 300 displays various pieces of information transmitted from the PLC 200.

The projecting device 100 includes: an impeller group 110 that projects the blasting medium 400 to the projection target object 500; a conveyer 120 that carries the projection target object 500; a distributor 130 that supplies the blasting medium 400 to the impeller group 110; a screw 140 that carries out stirring inside the projecting device 100; a bucket elevator 150 for recovering the blasting medium 400 which has been projected; and a dust collecting device 160 for collecting an undesired substance such as a burr separated from the projection target object 500. Note, however, that the projecting device 100 may also include other part(s) (not illustrated). The impeller group 110 includes at least one impeller. FIG. 1 illustrates an impeller 111 and an impeller 112, and do not illustrate the other impellers. This also applies to the drawings below. For example, in a case where the projection target object 500 has a long shape such as a steel frame, single projection is insufficient for the blasting medium to be projected to the projection target object as a whole. Thus, the conveyer 120 gradually carries the projection target object 500 to a position at which the projecting device 100 projects the blasting medium 400 (hereinafter, referred to as a projection position). Then, the projecting device 100 carries out projection while the projection target object 500 is being carried. Furthermore, in a case where the projection target object 500 is large with respect to the projecting device 100, the projecting device 100 may include, instead of the conveyer 120, a traveling body or the like for moving the projecting device 100 itself. The distributor 130 supplies, to each of the impellers of the impeller group 110, the blasting medium 400 in an amount that is appropriate for projection. The screw 140 carries out stirring inside the projecting device 100 and centrifuges, for example, (i) the blasting medium 400 which has been projected and (ii) a burr. The bucket elevator 150 recovers the blasting medium 400 thus centrifuged so as to refill the distributor 130 with the blasting medium 400. The dust collecting device 160 collects an undesired substance such as the centrifuged burr so as to dispose of the undesired substance. The impeller 111 includes a motor M1*a*, the impeller 112 includes a motor M1*b*, the conveyer 120 includes a motor M2, the distributor 130 includes a motor M3, the screw 140 includes a motor M4, the bucket elevator 150 includes a motor M5, and the dust collecting device 160 includes a motor M6.

The PLC 200 is connected to each section of the projecting device 100 and controls the projecting device 100. The PLC 200 includes a communication interface (I/F) 211, a memory 212, a processor 213, and an output-input I/F 214. The communication interface (I/F) 211, the memory 212, the processor 213, and the output-input I/F 214 are connected to each other via a bus.

Various information devices such as a meter (not illustrated) are connected to the communication I/F 211 via a communication network. In Embodiment 1, the communication network is an analog circuit such as a wired LAN. Alternatively, the communication network may be, for example, Ethernet (registered trademark), Wi-Fi (registered trademark), or CC-Link (registered trademark), or may be implemented in a cloud.

The memory 212 stores, for example, the following information:

(1) a maximum current value of each motor at shipment from a factory;

(2) a threshold of each motor and a determination condition for use in a first inspection process;

(3) a threshold of each motor and a determination condition for use in a second inspection process;

(4) a correlation between a conveyance speed of the conveyer 120 and a current value of the motor M2 of the conveyer 120; and (5) an inspection result determined by the processor 213

Examples of a device that can be used as the memory 212 include a flash memory.

The processor 213 carries out the first inspection process and the second inspection process. Examples of a device that can be used as the processor 213 include a central processing unit (CPU).

To the output-input I/F 214, an input device and/or an output device is/are connected. Examples of the output device that is connected to the output-input I/F 214 include a display and a printer. Examples of the input device that is connected to the output-input I/F 214 include a mouse and a keyboard. The output-input I/F 214 may be, for example, an HDMI (registered trademark) or a USB (registered trademark). In Embodiment 1, the display 300 serving as the output device is connected to the output-input I/F 214.

The display 300 is a screen for displaying an inspection result of the present shot-blasting device 1. Embodiment 1 employs a configuration such that a touch panel that can be operated by a user is used as the display 300. Note, however, that the present invention is not limited to such a configuration. The display 300 may be, for example, a personal computer (PC) including a monitor, or may include an input device (not illustrated) such as a mouse.

(Flow of Inspection Process)

The following description will discuss, with reference to FIGS. 2 to 6, a flow of the first inspection process and the second inspection process that are carried out by the shot-blasting device 1.

Figure 2:
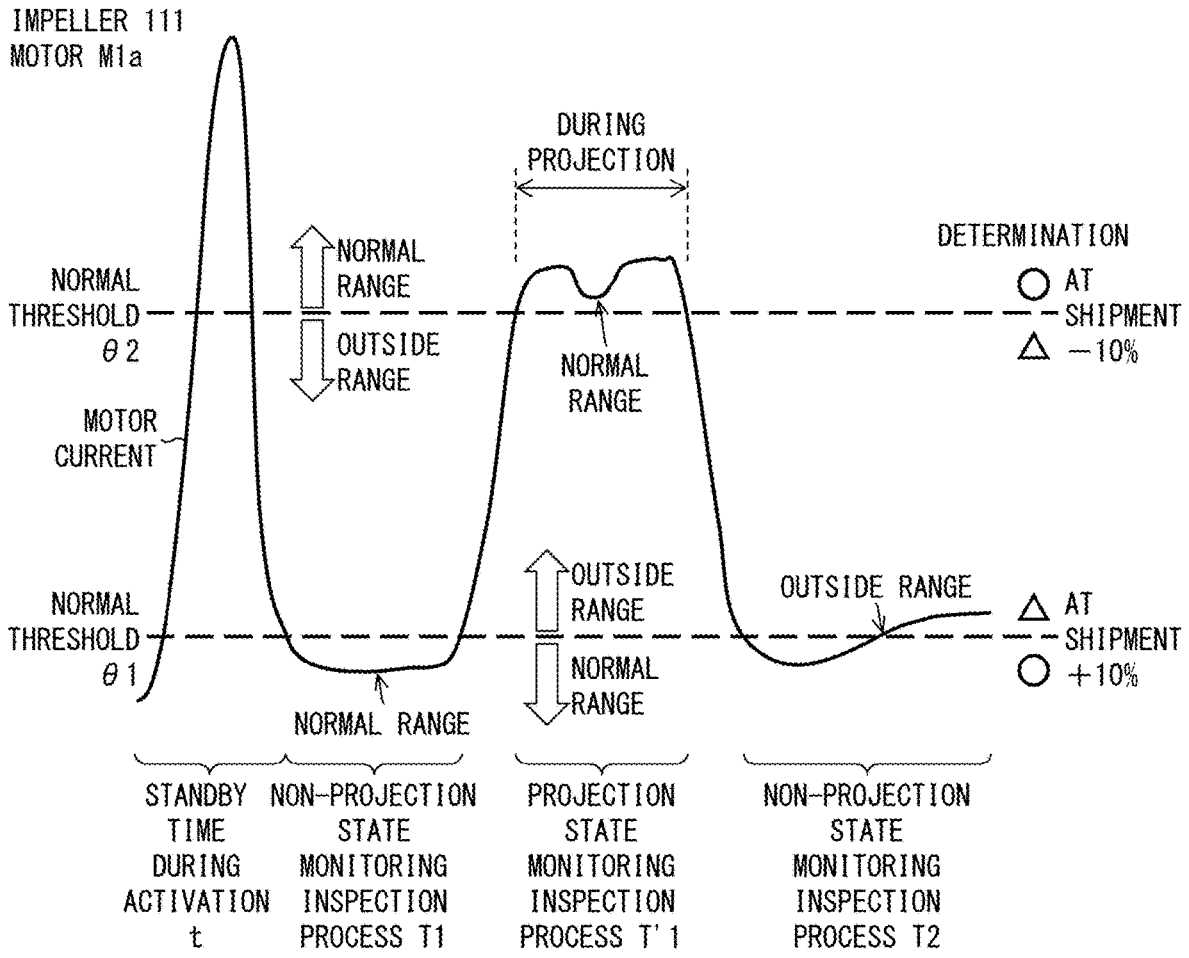
FIG. 2 is a diagram showing a time axis, a current value, and a determination logic in an inspection.
Figure 3:
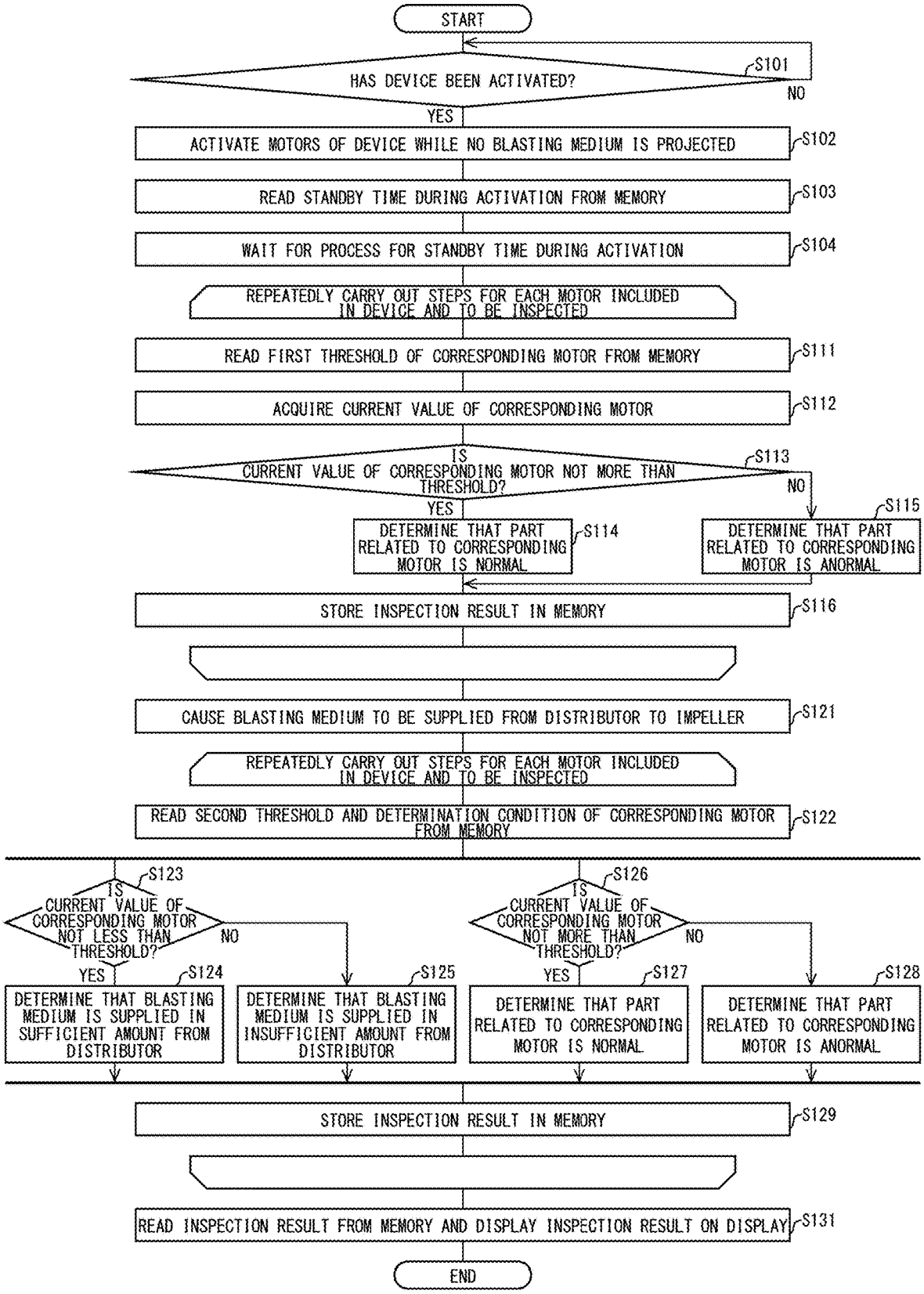
FIG. 3 is a flow chart showing a flow of an inspection process.

The following description will use FIGS. 2 and 3 to discuss a flow of an inspection process as a whole.

(Flow of Inspection as a Whole)

The following description will use FIG. 2 to discuss a flow of inspection as a whole. FIG. 2 is a graph showing a transition of a current value of the motor M1*a* of the impeller 111 after power-on of the projecting device 100.

Upon the power-on of the projecting device 100, a current amount of each of the motors of the projecting device 100 temporarily increases first and then returns to a lower level. During this period of time, the current amount fluctuates drastically, and such a drastic fluctuation in current amount is not suitable for the inspection in Embodiment 1. Thus, the processor 213 waits for a certain period of time from the power-on to an end of standby. This period of time is defined as a "standby time during activation t". Embodiment 1 assumes that the standby time during activation t is stored in the memory 212 in advance. Alternatively, for example, the processor 213 may calculate the standby time during activation t from the current value of the motor M1*a*.

After the standby time during activation t has passed, the motors M1*a* and M1*b* are not loaded with the blasting medium 400 in a state in which the impeller 111 projects no blasting medium 400 (hereinafter, referred to as a non-projection state). Thus, for example, in a case where the motor M1*a* and a part involved in driving of the motor M1*a* are normal, the current value of the motor M1*a* transitions at a low level. In a case where the current value of the motor M1*a* is higher than a predetermined level in the state in which the impeller 111 projects no blasting medium 400, any anomaly may occur in the motor M1*a* of the projecting device 100 or the part involved in driving of the motor M1*a*. An anomaly is considered to be not only a case where the motor M1*a* malfunctions but also a case of other mechanical defects having occurred in the part involved in driving of the motor M1*a*. The processor 213 carries out a non-projection state monitoring inspection process T1 (the first inspection process) in order to determine the current value during a period of the non-projection state. A threshold for determining that the current value is normal is defined as a threshold θ1. In a case where it is determined by the non-projection state monitoring inspection process T1 that the motor M1*a* has a current value of not more than θ1, the processor 213 determines that a part related to the motor M1*a* is normal. In the drawings below, "the motor M1*a* and the part involved in driving of the motor M1*a* are normal" is described as "the part related to the motor M1*a* is normal".

Next, while the impeller 111 is projecting the blasting medium 400 (hereinafter referred to as a projection state), the current value of the motor M1*a*, which is loaded with the blasting medium 400, transitions at a high level. In a case where the current value of the motor M1*a* is at a level lower than a predetermined level, an amount of supply of the blasting medium 400 from the distributor 130 to the impeller 111 may be insufficient to maintain the projection density. In this case, it is impossible to maintain processing quality of the shot-blasting device 1. This requires, for example, the processor 213 to cause the distributor 130 to increase the amount of supply of the blasting medium 400. The processor 213 carries out a projection state monitoring inspection process T'1 (the second inspection process) while the impeller 111 is projecting the blasting medium 400. A threshold for determining that the current value in the projection state is normal is defined as a threshold θ2. In a case where it is determined by the projection state monitoring inspection process T'1 that the motor M1*a* has a current value of not less than θ2, the processor 213 determines that the amount of supply of the blasting medium 400 to the impeller 111 is sufficient.

The processor 213 automatically carries out the non-projection state monitoring inspection process T1 (described earlier) and the projection state monitoring inspection process T'1 (described earlier) after production is actually started and before the projecting device 100 carries out projection with respect to the projection target object 500, and shows an inspection result to the user. This makes it possible to prevent (i) stopping of the production line and (ii) production of a defective product without depending on visual determination by an inspector.

Note that the thresholds θ1 and θ2 can be set for each of the motors and can be changed at any time. Note also that the determination condition "not less than the threshold", "not more than the threshold", "more than the threshold", or "less than the threshold" can be arbitrarily set for each of the motors in the projection state monitoring inspection process T'1. In Embodiment 1, assuming that the maximum current value of the motor M1*a* at shipment from the factory is 100%, 10% and 90% thereof are set as the threshold θ1 and the threshold θ2, respectively.

Each of the above inspections may be carried out with respect to a motor(s) different from the motor of the impeller. For some of the motors different from the motors of the impeller group 110, the processor 213 cannot determine whether the current value in a state in which the impeller group 110 projects no blasting medium 400 is not more than the threshold θ1. Thus, the processor 213 may determine, as the second inspection process, i.e., the projection state monitoring inspection process, whether the current value of a corresponding motor is not more than the threshold θ2. In this case, when the current value of the corresponding motor is not more than the threshold θ2, the processor 213 may determine that a part related to the corresponding motor is normal. For each of the motors that are included in the projecting device 100 and that are different from the motors of the impeller group 110, it is possible to determine whether the non-projection state monitoring inspection process or the projection state monitoring inspection process is used to determine whether a part related to a corresponding motor is normal. Furthermore, the determination as to which of the non-projection state monitoring inspection process and the projection state monitoring inspection process to use can be changed by the user at any time for each of the motors.

Note that the processor 213 may carry out processes identical to the non-projection state monitoring inspection process T1 and the projection state monitoring inspection process T'1 in the non-projection state and the projection state, respectively, after production is actually started.

The following description will use the flow chart of FIG. 3 to discuss a series of flows in which the processor 213 carries out the first inspection process, the second inspection process, and the display process. "DEVICE" in FIG. 3 indicates the projecting device 100.

(Non-Projection State Monitoring Inspection Process)

In a step S101, the processor 213 determines whether the projecting device 100 has been activated. The determination may be carried out by, for example, detecting current values to various current meters (not illustrated). In a case where the projecting device 100 is inactive (NO in S101), the processor 213 continues to wait. In a case where the projecting device 100 is active (YES in S101), the processor 213 proceeds to a step S102. Note that the processor 213 may start the inspection process in response to an operation of the user instead of automatically starting the inspection process in the step S101.

In the step S102, the processor 213 activates the motors of the projecting device 100 while no blasting medium 400 is introduced.

In a step S103, the processor 213 reads the standby time during activation t from the memory 212.

In a step S104, the processor 213 waits for the process for the standby time during activation t.

Subsequent steps up to a step S116 are repeatedly carried out for each of the motors that are included in the projecting device 100 and that are to be inspected. It may be determined in advance for each of the motors whether each of the motors is to be inspected.

In a step S111, the processor 213 reads the first threshold θ1 from the memory 212. The threshold θ1 may vary for each of the motors, or may be uniform for all the motors.

In a step S112, the processor 213 acquires a current value of each of the motors of the projecting device 100.

In a step S113, the processor 213 determines whether the current value of each of the motors of the projecting device 100 is not more than the threshold θ1. In a case where the current value of a corresponding motor of the projecting device 100 is not more than the threshold θ1, the processor 213 proceeds to a step S114 (YES in the step S113). In a case where the current value of the corresponding motor of the projecting device 100 is more than the threshold θ1, the processor 213 proceeds to a step S115 (NO in the step S113). Any of the motors may be to be inspected, and only the motors included in the impeller group 110 or all the motors included in the projecting device 100 may be to be inspected.

In the step S114, the processor 213, determines, for the corresponding motor the current value of which is not more than the threshold θ1, that a part related to the corresponding motor is normal.

In the step S115, the processor 213, determines, for the corresponding motor the current value of which is more than the threshold θ1, that the part related to the corresponding motor is anormal.

In the step S116, the processor 213 stores an inspection result in the memory 212. The inspection result is data obtained by combining the corresponding motor and the result, determined in the step S114 or S115, that the part related to the corresponding motor is normal or anormal.

(Projection State Monitoring Inspection Process)

In a step S121, the processor 213 causes the blasting medium 400 to be supplied from the distributor 130 to the impeller group 110. That is, the processor 213 creates a state in which the impeller group 110 is projecting the blasting medium 400, and then carries out the projection state monitoring inspection process.

Subsequent steps up to a step S129 are repeatedly carried out for each of the motors that are included in the projecting device 100 and that are to be inspected. It may be determined in advance for each of the motors whether each of the motors is to be inspected. Only the motors included in the impeller group 110 may be to be inspected.

In a step S122, the processor 213 reads, from the memory 212, the second threshold θ2 and the determination condition of a corresponding motor. The threshold θ2 may vary for each of the motors, or may be uniform for all the motors. Furthermore, the determination condition "not less than the threshold" or "not more than the threshold" may be set for each of the motors. The determination condition may include "more than the threshold" or "less than the threshold" in addition to "not less than the threshold" or "not more than the threshold". However, for convenience, a description is given assuming that the determination condition is "not less than the threshold" or "not more than the threshold". In a case where the determination condition of the corresponding motor is "not less than the threshold θ2", the process proceeds to a step S123. In a case where the determination condition of the corresponding motor is "not more than the threshold θ2", the process proceeds to a step S126. Embodiment 1 assumes that the determination condition "not less than the threshold θ2" is set for a motor of the impeller group 110 and that the determination condition "not more than the threshold θ2" is set for a motor different from the motors of the impeller group 110.

In the step S123, the processor 213 determines whether the current value of the motor of the impeller group 110 is not less than the threshold θ2.

In a step S124, the processor 213 determines, for the motor of the impeller group 110 which motor has the current value that is not less than the threshold θ2, that the blasting medium 400 is supplied in a sufficient amount from the distributor 130.

In a step S125, the processor 213 determines, for the motor of the impeller group 110 which motor has the current value that is less than the threshold θ2, that the blasting medium 400 is supplied in an insufficient amount from the distributor 130.

In the step S126, the processor 213 determines whether the current value of the motor different from the motors of the impeller group 110 is not more than the threshold θ2.

In a step S127, the processor 213 determines, for a corresponding motor the current value of which is not more than the threshold θ2 and which is different from the motors of the impeller group 110, that a part related to the corresponding motor is normal.

In a step S128, the processor 213 determines, for the corresponding motor the current value of which is more than the threshold θ2 and which is different from the motors of the impeller group 110, that a part related to the corresponding motor is anormal.

In a step S129, the processor 213 stores an inspection result in the memory 212. Specifically, the processor 213 stores, in the memory 212, an inspection result of the step S124 or the step S125 and an inspection result of the step S127 or the step S128. The inspection result refers to data obtained by combining the corresponding motor and a determination result of the step S124 or the step S125 as to whether the blasting medium 400 is sufficiently supplied from the distributor 130, and data obtained by combining the corresponding motor and a determination result of the step S127 or the step S128 as to whether the part related to the corresponding motor is normal or anormal.

(Display Process)

In a step S131, the processor 213 displays the inspection results on the display 300 via the output-input I/F 214.

(Examples of Display Process)

Figure 4:
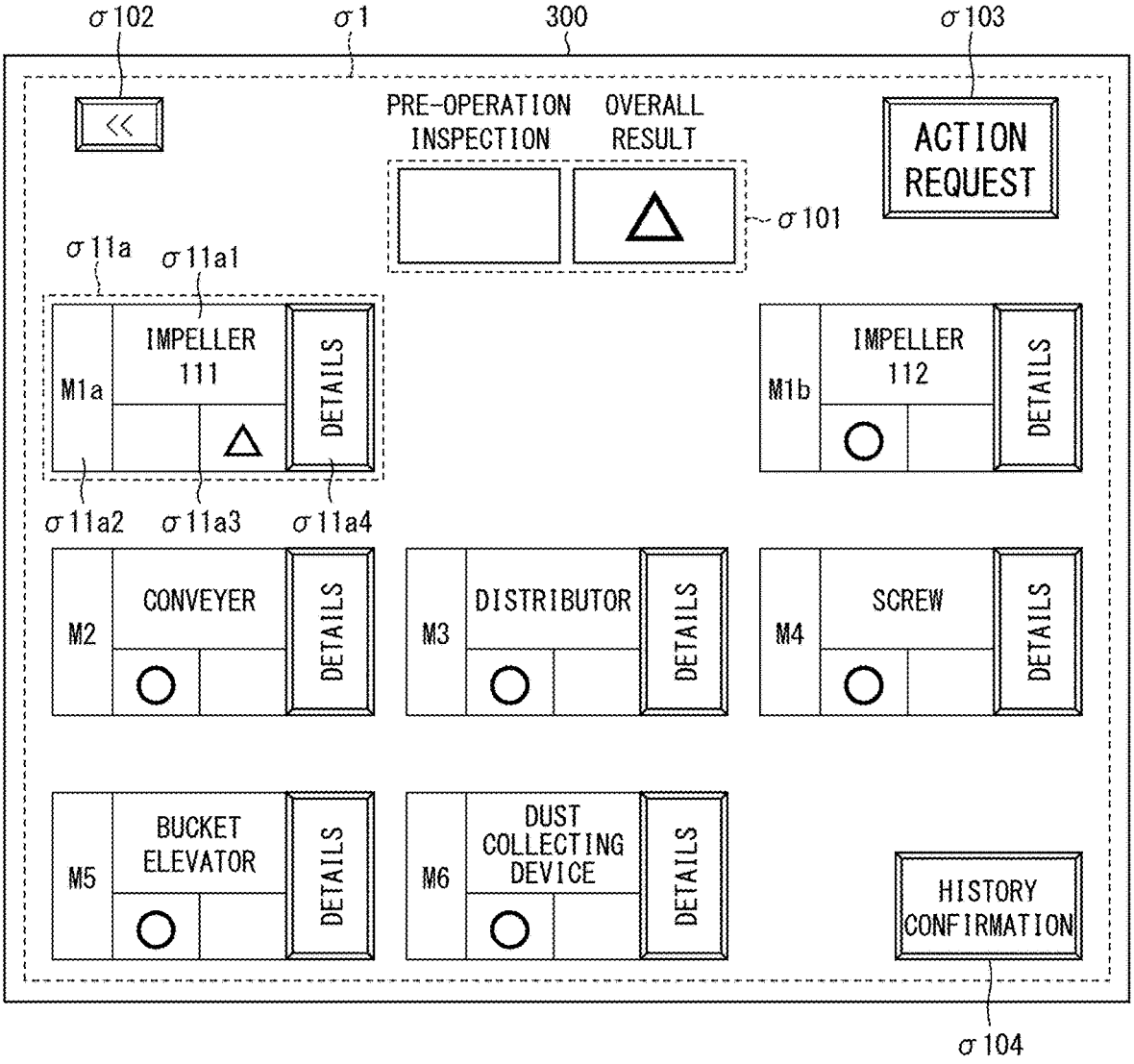
FIG. 4 is a view illustrating an example of a screen for displaying an inspection result.
Figure 5:
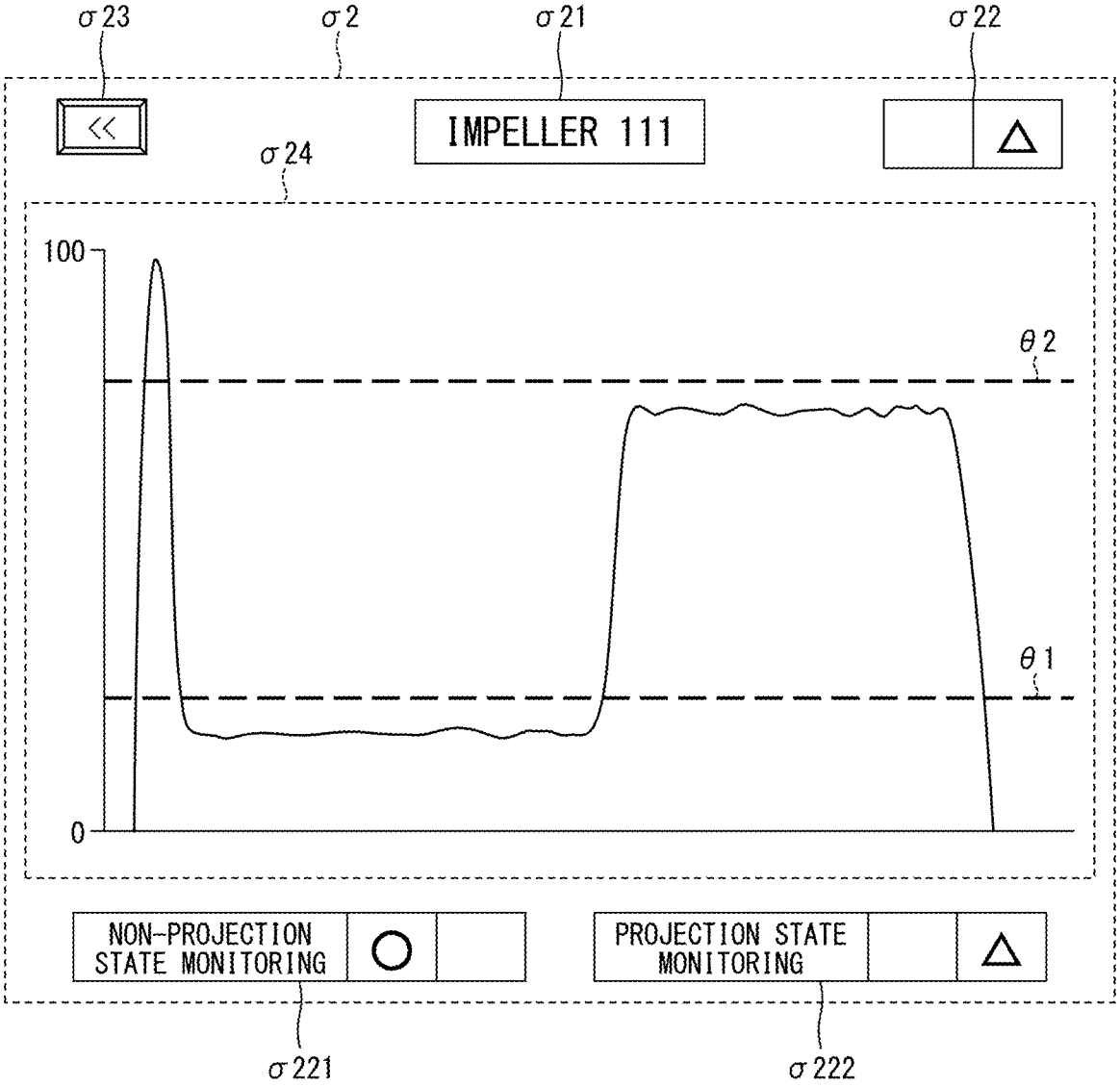
FIG. 5 is a view illustrating an example of a screen for displaying an inspection result.

The following description will discuss, with reference to FIGS. 4 to 6, examples of a screen that is displayed on the display 300 by a display process carried out in the step S131 of FIG. 3. Note that any of the examples described below is merely an example, and each display region may be displayed in a different configuration.

FIG. 4 is an example of a screen σ1 that the processor 213 displays on the display 300 in the step S131 of FIG. 3. The screen σ1 displays, not only for each of the motors of the projecting device 100 but also in a generalized manner, results of the non-projection state monitoring inspection process and the projection state monitoring inspection process that have been carried out before operation (after the device is activated and before the blasting medium is projected to the projection target object). In Embodiment 1, "○" indicates that "the part related to the motor is normal" or that "the blasting medium is supplied in a sufficient amount from the distributor", and "Δ" indicates that "the part related to the motor is anormal" or that "the blasting medium is supplied in an insufficient amount from the distributor". Same applies to the drawings below. In order to briefly indicate an inspection result, it is possible to replace "○" and "Δ" with other symbols or words such as "good" and "poor". In Embodiment 1, "○" and "Δ" are displayed at horizontally separated positions. Note, however, that the positions at which "○" and "Δ" are displayed do not need to be horizontally separated. Same applies to all result display regions described later. The screen σ1 has an overall result display region σ101, a screen transition button σ102, an action request button σ103, a history confirmation button σ104, and display regions corresponding to the respective motors of the projecting device 100. Embodiment 1 describes a display region σ11*a* corresponding to the motor M1*a* of the impeller 111, and does not describe the display regions corresponding to the other respective motors because those display regions are similar to the display region of σ11*a*.

The processor 213 collectively displays, in the overall result display region σ101, inspection results for all the motors that have been subjected to at least one of the non-projection state monitoring inspection process and the projection state monitoring inspection process. Note that a display concerning a motor that has not been inspected may be included. In Embodiment 1, if a result that "the part related to the motor is anormal" or "the blasting medium is supplied in an insufficient amount from the distributor" is obtained in at least one of the motors that have been subjected to at least one of the non-projection state monitoring inspection process and the projection state monitoring inspection process, "Δ" is displayed in the overall result display region σ101. If not, "○" is displayed in the overall result display region σ101. In the case of Embodiment 1, "Δ" is displayed in the overall result display region σ101 because the result that "the part related to the motor is anormal" or "the blasting medium is supplied in an insufficient amount from the distributor" has been obtained in the motor M1*a*.

The screen transition button σ102 receives an operation of the user. In a case where the screen transition button σ102 receives an input from the user, the processor 213 causes the screen σ1 to transition to another screen (not illustrated). The action request button σ103 receives an operation of the user. In a case where the action request button σ103 receives an input from the user, the processor 213 notifies, for example, another PC on a network (not illustrated) via the screen σ1 that an action is necessary. For example, in a case where a result that "the motor M1*a* is anormal" is obtained, the processor 213 notifies another PC on a network (not illustrated) that it is necessary to inspect, repair, or replace the motor M1*a*. The history confirmation button σ104 receives an operation of the user. In a case where the history confirmation button σ104 receives an input from the user, the processor 213 causes the screen σ1 to transition to a screen σ3.

The display region σ11*a* has a member name display region σ11*a*1, a motor name display region σ11*a*2, a result display region σ11*a*3, and a details display button σ11*a*4.

In the member name display region σ11*a*1, the processor 213 displays a name of a member that is included in the projecting device 100 and that has a motor. In the case of Embodiment 1, "IMPELLER 111" is displayed. However, for example, "IMPELLER No. 1" or the like may be alternatively displayed. In the motor name display region σ11*a*2, the processor 213 displays a name of a motor. In the result display region σ11*a*3, the processor 213 displays the generalized results of the non-projection state monitoring inspection process and the projection state monitoring inspection process for the motor M1*a*. If the result that "the part related to the motor is anormal" or "the blasting medium is supplied in an insufficient amount from the distributor" has been obtained for a corresponding motor, the processor 213 displays "Δ" in the result display region σ11*a*3. If not, the processor 213 displays "○" in the result display region σ11*a*3. The details display button σ11*a*4 receives an operation of the user and causes the screen σ1 to transition to a screen σ2 described later.

FIG. 5 is an example of the screen σ2 that the processor 213 displays on the display 300 in the step S131 of FIG. 3. The screen σ2 is a screen on which, in order to enable the user to understand details of an inspection result, the processor 213 displays (i) a graph showing a relationship between a time series and the current value of the motor M1*a* of the impeller 111 and (ii) a result of the non-projection state monitoring inspection process and a result of the projection state monitoring inspection process. The screen σ2 has a target member name display region σ21, a result display region σ22, a non-projection state monitoring result display region σ221, a projection state monitoring result display region σ222, a screen transition button σ23, and a current value transition graph display region σ24.

In the target member name display region σ21, the processor 213 displays a name of a member that has a corresponding motor to be inspected, but may alternatively display a name of the corresponding motor. In the case of Embodiment 1, the "IMPELLER 111" that has the motor M1*a* to be inspected is displayed.

In the result display region σ22, the processor 213 carries out a display similar to the display in the result display region σ11*a*3 of FIG. 4. In the non-projection state monitoring result display region σ221, the processor 213 displays the result of the non-projection state monitoring inspection process for the motor M1*a*. In the projection state monitoring result display region σ222, the processor 213 displays the result of the projection state monitoring inspection process for the motor M1*a*.

The screen transition button σ23 receives an operation of the user and causes the screen σ2 to transition to the screen σ1.

The current value transition graph display region σ24 is a graph showing a transition of the current value of the motor M1*a*. The vertical axis shows the current value of the motor M1*a*, and the horizontal axis shows time. The horizontal axis can be a time axis that is set by the user. Embodiment 1 assumes that time during which the non-projection state monitoring inspection process T1 and the projection state monitoring inspection process T'1 have been carried out after power-on of the projecting device 100 is displayed. In Embodiment 1, "○" is displayed in the non-projection state monitoring result display region σ221 because the motor M1*a* is normal as a result of the non-projection state monitoring inspection process T1. In contrast, since the current value of the motor M1*a* in the projection state is less than the threshold θ2, a determination result of the projection state monitoring inspection process T'1 is that the blasting medium 400 is supplied in an insufficient amount from the distributor 130 to the impeller 111. Thus, "Δ" is displayed in the projection state monitoring result display region σ222. A reason for this may be due to, for example, a failure of a cage (not illustrated) that connects the distributor 130 and the impeller 111. By thus individually displaying details of a current value transition graph, the processor 213 enables the user to properly understand a position of the failure.

FIG. 6 is an example of the screen σ3 that the processor 213 displays on the display 300 in the step S131 of FIG. 3. The screen σ3 is used by the processor 213 to list and display past inspection histories so as to allow reference by the user. The screen σ3 has the screen transition button σ23 and an inspection history list σ31. The screen transition button σ23 is identical to that of FIG. 5.

In the inspection history list σ31, for each inspection starting date and time, the processor 213 lists and displays (i) (a) the result of the non-projection state monitoring inspection process and (b) the result of the projection state monitoring inspection process for each of the motors of the projecting device 100 and (ii) an inspection result obtained by generalizing the results (a) and (b). In FIG. 6, the processor 213 displays, as a column heading, a name of a member that has a corresponding motor, but alternatively may display a name of the corresponding motor. "NON-PROJECTION" indicates the result of the non-projection state monitoring inspection process, and "PROJECTION" indicates the result of the projection state monitoring inspection process. In an "OVERALL" column, if either the result of the non-projection state monitoring inspection process or the result of the projection state monitoring inspection process is "Δ" in any of the motors of the projecting device 100, the processor 213 displays "Δ", i.e., that there is a problem. If not, the processor 213 displays "○". In Embodiment 1, regarding the latest non-projection state monitoring inspection process and the latest projection state monitoring inspection process that were carried out at 11:24 on July 24, the processor 213 displays "Δ" in the "OVERALL" column because the result of the projection state monitoring inspection process was "Δ" for the motor M1*a* of the impeller 111.

Embodiment 2

The following description will discuss another embodiment of the present invention. Note that for convenience, members having functions identical to those of the respective members described in Embodiment 1 are given respective identical reference numerals, and a description of those members is omitted.

In a case where a conveyer 120 carries a projection target object 500 in a projection process, a conveyance speed causes a fluctuation in projection density. This makes it necessary to consider the conveyance speed in determining whether an amount of supply of a blasting medium 400 is proper. For example, a deterioration over time in a motor M2 of the conveyer 120 reduces the conveyance speed. A lower conveyance speed may make the projection density too high to maintain projection quality. Thus, a processor 213 may determine whether the conveyance speed of the conveyer 120 is in a predetermined range. Since the conveyance speed of the conveyer 120 correlates with an operation frequency of the motor M2, a memory 212 may maintain, in advance, a correspondence between the operation frequency of the motor M2 and the conveyance speed of the conveyer 120. Furthermore, the processor 213 may read such correlation data from the memory 212 and calculate the conveyance speed of the conveyer 120 from an inverter frequency of the motor M2. Specifically, by comparing the conveyance speed in terms of the inverter frequency of the motor M2 with the conveyance speed to which counts of a rotation detection sensor attached to a roller (not illustrated) of the conveyer 120 have been converted, the processor 213 may calculate whether the conveyance speed of the conveyer 120 is normal.

Moreover, in accordance with a result of a projection state monitoring inspection process and the conveyance speed of the conveyer 120, the processor 213 may carry out a third inspection process for determining whether a state of projection from an impeller group 110 is proper, and, in a display process, the processor 213 may display, on a display, a determination result of the third inspection process.

ADDITIONAL REMARKS

The present invention is not limited to the embodiments described above, and may be altered in various ways by a skilled person within the scope of the claims. The present invention also encompasses, in its technical scope, any embodiment derived from a proper combination of technical means disclosed in the embodiments described above. For a threshold, "not less than the threshold" and "not more than the threshold" may be replaced with "more than the threshold" and "less than the threshold", respectively.

[Software Implementation Example]

Functions of the shot-blasting device 1 (hereinafter referred to as a "device") can be realized by a program for causing a computer to function as the device, the program causing the computer to function as control blocks (in particular, sections of a processor) of the device.

The program may be recorded in one or more non-transitory computer-readable recording media. The recording media may be included in the device or need not be included in the device. In the latter case, the program may be supplied to the device via any wired or wireless transmission medium.

Furthermore, some or all of functions of the control blocks can also be realized by a logic circuit. For example, the scope of the present invention also encompasses an integrated circuit in which a logic circuit that functions as the control blocks is provided. In addition, the functions of the control blocks can also be realized by, for example, a quantum computer.

The present invention is not limited to the embodiments described above, and may be altered in various ways by a skilled person within the scope of the claims. The present invention also encompasses, in its technical scope, any embodiment derived from a proper combination of technical means disclosed in differing embodiments.

REFERENCE SIGNS LIST

1 Shot-blasting device
100 Projecting device
110 Impeller group
111 Impeller
120 Conveyer
130 Distributor
200 PLC
212 Memory
213 Processor
300 Display
400 Blasting medium
500 Projection target object
M1*a*, M2 Motor
t Standby time during activation
T1 Non-projection state monitoring inspection process
T1 Projection state monitoring inspection process
θ1, θ2 Threshold
σ1, σ2, σ3 Screen

The invention claimed is:

1. A shot-blasting device comprising:

at least one impeller each of which has at least one motor and projects a blasting medium to at least one projection target object;

a memory which stores a threshold and a determination condition for use in an inspection process, and records a determination result, and at least one processor, the at least one processor carrying out a first inspection process and a second inspection process after a device is activated and before the blasting medium is projected to the at least one projection target object, the first inspection process being a process in which, in a state where no blasting medium is supplied to the at least one impeller while the at least one motor is rotating, the at least one processor reads a first threshold from the memory, the at least one processor determines whether a current value supplied to each of the at least one motor of the at least one impeller is not more than the first threshold, and the at least one processor stores a result of the determination as a first inspection result in the memory, the second inspection process being a process in which, in a state where the at least one impeller is projecting the blasting medium, the at least one processor reads a second threshold from the memory, the at least one processor determines whether the current value supplied to each of the at least one motor of the at least one impeller is not less than the second threshold, and the at least one processor stores a result of the determination as a second inspection result in the memory, the at least one processor reading the first inspection result and the second inspection result from the memory, the at least one processor carrying out a display process for displaying, on a display, at least one of (1) the result of the determination, given by the at least one processor, of the first inspection process and the result of the determination, given by the at least one processor, of the second inspection process or (2) a determination result obtained by the at least one processor generalizing the result of the determination, given by the at least one processor, of the first inspection process and the result of the determination, given by the at least one processor, of the second inspection process, the first inspection process carrying out an inspection for a defect in the at least one motor or a part involved in driving of the at least one motor, the second inspection process carrying out an inspection as to an amount of supply of the blasting medium to the at least one impeller, and in a case where the current value supplied to each of the at least one motor of the at least one impeller is lower than the second threshold, the at least one processor is configured to cause an increase in the amount of supply of the blasting medium to the at least one impeller.

2. The shot-blasting device as set forth in claim 1, wherein the at least one processor sequentially carries out the first inspection process and the second inspection process in this order.

3. The shot-blasting device as set forth in claim 1, wherein in the first inspection process, the at least one processor further determines, for at least some of motors that the shot-blasting device has in addition to the at least one motor of the at least one impeller, whether one or more current values are not more than respective thresholds.

4. The shot-blasting device as set forth in claim 1, wherein in the second inspection process, the at least one processor further determines, for at least some of motors that the shot-blasting device has in addition to the at least one motor of the at least one impeller, whether one or more current values are not more than respective thresholds.

5. The shot-blasting device as set forth in claim 1, further comprising a conveyer that carries the at least one projection target object, the at least one processor carrying out a process for acquiring a conveyance speed at which the conveyer is to carry the at least one projection target object, and the at least one processor determining whether the conveyance speed is in a predetermined range.

6. The shot-blasting device as set forth in claim 1, wherein the at least one processor reads a standby time during activation from the memory, and the at least one processor stands by during a passage of the standby time during activation after a projecting device including the at least one impeller is turned on, and then the at least one processor carries out the first inspection process.

7. A non-transitory computer-readable storage medium storing therein a program for causing a computer including the at least one processor to function as the shot-blasting device according to claim 1, the program causing the at least one processor to carry out the first inspection process, the second inspection process, and the display process.

8. A method for controlling a shot-blasting device including at least one impeller each of which has at least one motor and projects a blasting medium to at least one projection target object, said method comprising:

carrying out a first inspection process and a second inspection process after a device is activated and before the blasting medium is projected to the at least one projection target object, the first inspection process being a process in which, in a state where no blasting medium is supplied to the at least one impeller while the at least one motor is rotating, the shot-blasting device reads a first threshold from a memory of the shot-blasting device, the shot-blasting device determines whether a current value supplied to each of the at least one motor of the at least one impeller is not more than the first threshold, and the shot-blasting device stores a result of the determination as a first inspection result in the memory of the shot-blasting device, the second inspection process being a process in which, in a state where the at least one impeller is projecting the blasting medium, the shot-blasting device reads a second threshold from the memory, the shot-blasting device determines whether the current value supplied to each of the at least one motor of the at least one impeller is not less than the second threshold, and the shot-blasting device stores a result of the determination as a second inspection result in the memory;

reading the first inspection result and the second inspection result from the memory;

carrying out a display process for displaying, on a display, at least one of (1) the result of the determination, given by the shot-blasting device, of the first inspection process and the result of the determination, given by the shot-blasting device, of the second inspection process or (2) a determination result obtained by the shot-blasting device generalizing the result of the determination, given by the shot-blasting device, of the first inspection process and the result of the determination, given by the shot-blasting device, of the second inspection process, the first inspection process carrying out an inspection for a defect in the at least one motor or a part involved in driving of the at least one motor, the second inspection process carrying out an inspection as to an amount of supply of the blasting medium to the impeller, and in a case where the current value supplied to each of the at least one motor of the at least one impeller is lower than the second threshold, causing an increase in the amount of supply of the blasting medium to the at least one impeller.

9. The method as set forth in claim 8, wherein the shot-blasting device reads a standby time during activation from the memory, and the shot-blasting device stands by during a passage of the standby time during activation after a projecting device including the at least one impeller is turned on, and then the shot-blasting device carries out the first inspection process.

* * * * *